US008398184B1

(12) United States Patent
Benneche et al.

(10) Patent No.: US 8,398,184 B1
(45) Date of Patent: Mar. 19, 2013

(54) THERMAL BARRIER AND CONSTRAINING APPARATUS TO RETAIN COLD AIR AND CONSTRAIN CONTAINERS ON A SHELF FIXTURE WITHIN A COMPARTMENT

(76) Inventors: John Christian Benneche, Long Beach, CA (US); Kelly Boehm Brown, Long Beach, CA (US)

( * ) Notice: Subject to any disclaimer, the term of this patent is extended or adjusted under 35 U.S.C. 154(b) by 0 days.

(21) Appl. No.: 13/426,766

(22) Filed: Mar. 22, 2012

Related U.S. Application Data

(63) Continuation-in-part of application No. 11/949,644, filed on Dec. 3, 2007, now abandoned.

(51) Int. Cl.
*A47B 81/00* (2006.01)

(52) U.S. Cl. ..... 312/292

(58) Field of Classification Search ..... 312/291, 312/292; 211/180, 119.03; 160/370.21, 160/354, 368.11, DIG. 13, DIG. 18
See application file for complete search history.

(56) References Cited

U.S. PATENT DOCUMENTS

| | | | | | |
|---|---|---|---|---|---|
| 673,703 | A | * | 5/1901 | Doyle | 49/465 |
| 2,041,258 | A | | 5/1936 | Mitchell | |
| 2,127,379 | A | | 8/1938 | Adams | |
| 2,585,136 | A | | 2/1952 | Kuchler | |
| 3,762,790 | A | * | 10/1973 | Neuwirth | 312/328 |
| 3,938,872 | A | * | 2/1976 | Hagerman | 312/291 |
| 4,109,484 | A | | 8/1978 | Cunningham | |
| 4,192,542 | A | * | 3/1980 | Hill | 296/173 |
| 4,288,992 | A | | 9/1981 | Eliason | |
| 4,296,792 | A | | 10/1981 | Gidge et al. | |
| 4,310,044 | A | | 1/1982 | Schenker | |
| 4,313,485 | A | | 2/1982 | Gidge et al. | |
| 4,400,046 | A | | 8/1983 | Karashima | |
| 4,420,027 | A | | 12/1983 | Gidge et al. | |
| 4,429,548 | A | | 2/1984 | Layne | |
| 4,550,760 | A | | 11/1985 | Gidge et al. | |
| 4,874,028 | A | * | 10/1989 | Lynch et al. | 160/332 |
| 5,035,460 | A | * | 7/1991 | Huang | 296/95.1 |
| 5,427,169 | A | * | 6/1995 | Saulters | 160/368.1 |
| 5,427,486 | A | * | 6/1995 | Green | 410/118 |
| 5,431,490 | A | | 7/1995 | Edwards | |
| 5,529,363 | A | * | 6/1996 | Borowski, Jr. | 296/24.41 |
| 5,531,258 | A | * | 7/1996 | Poulson et al. | 160/376 |
| 5,558,386 | A | * | 9/1996 | Tilly et al. | 296/65.05 |
| 5,988,256 | A | * | 11/1999 | Winters | 160/310 |
| 6,026,886 | A | * | 2/2000 | Diamond-Martinez | 160/113 |
| 6,231,101 | B1 | * | 5/2001 | Kamida et al. | 296/63 |
| 6,783,199 | B2 | | 8/2004 | Parrott | |
| 2001/0033084 | A1 | * | 10/2001 | Murray et al. | 296/24.1 |
| 2005/0241783 | A1 | * | 11/2005 | Geres | 160/368.1 |

* cited by examiner

*Primary Examiner* — James O Hansen
*Assistant Examiner* — Matthew Ing
(74) *Attorney, Agent, or Firm* — George P. White

(57) ABSTRACT

A thermal barrier and retaining apparatus including a flexible sheet for deployment in blocking relationship over the front edge of a horizontal shelf fixture in a compartment, in which said sheet with downward opening and resealable panels for access into compartment while in place is attached to mounting devices mounted to the inside wall surfaces of a refrigerator, cabinet or shelving fixture to retain cold air and containers from escaping therefrom.

11 Claims, 3 Drawing Sheets

THERMAL BARRIER AND CONSTRAINING APPARATUS TO RETAIN COLD AIR AND CONSTRAIN CONTAINERS ON A SHELF FIXTURE WITHIN A COMPARTMENT

CROSS-REFERENCES TO RELATED APPLICATIONS

This application is a continuation-in-part claiming priority to continuation-in-part Ser. No. 12/586,410, entitled A Thermal Barrier and Constraining Apparatus to Retain Cold Air and Constrain Containers on a Shelf, filed on Sep. 22, 2009, a continuation-in-part claiming priority to continuation-in-part Ser. No. 12/538,679, entitled Constraining Apparatus to Constrain Containers On A Shelf filed on Aug. 10, 2009, design application Ser. No. 29/328,806, entitled Constraining Apron For Constraining Items From Falling Off The Front Edge Of A Shelf filed on Dec. 2, 2008, and non-provisional application Ser. No. 11/949,644, entitled Constraining Apparatus To Constrain Containers On A Shelf filed on Dec. 3, 2007, and provisional application No. 60/872,295, entitled Christar's Net, filed on Dec. 4, 2006 all of which are hereby incorporated by reference in its entirety.

BACKGROUND OF THE INVENTION

1. Field of the Invention

The present invention relates to retainers for constraining and retaining products on a shelf fixture within a compartment against ejection movement under influence of acceleration and deceleration forces and for the retaining of cold air within refrigerators.

2. Description of the Prior Art

With the growth of population in modern society and added leisure time, the attraction to recreational vehicles (RVs) for quality transportation and relaxation has come to the fore. The quality of the experience is often enhanced by easy access to food stuffs and beverages. To minimize deterioration in food stuffs and add to the attraction of beverages, it is important that the RV users have access to cold storage. Initially, it was popular to utilize so called coolers which could receive blocks or cubes of ice to maintain the beverage and food stuff cooled during the outings. These devices had the shortcoming that the food stuffs could only be maintained cold for a limited period of time and that the melting ice would often have deleterious affects on the food stuff and create an untidy situation within the confines of the boat, van or motor home.

In more recent times compact coolers have gained popularity. Coolers were initially cooled by heat exchange systems driven by liquid or gaseous fluids. More recently, such cooling refrigerators are powered by electrical power, either direct current or alternating current.

Inherent in the use of recreational vehicles are moving forces caused by the momentum of the vehicle during linear acceleration and deceleration, angular acceleration, and even tilting of the vehicle or of the road or marine vehicle during turns, tacking or jibing. Recreational vehicle refrigerators typically incorporate a limited number of horizontal shelves on which containers of food or beverages are stored. Barring any change in acceleration the containers tend to remain at rest on the shelf. When the vehicle carries the refrigerator through a change in magnitude of, or direction of velocity, the containers on the shelves tend to maintain their original velocity typically sliding across the shelf crashing against one another and against the sidewalls of the refrigerator or against the closed door or, if open, outwardly onto the floor of the house trailer or boat. This then often times results in crashing of the containers into one another and sometimes leading to spillage of food stuff and beverages or even breakage of fragile containers thereby to a great degree detracting from the quality of enjoyment. It is this problem to which is addressed by the present invention.

It is already been recognized that there is a need for containing articles from escape over the front edge of the horizontal shelves of cabinetry, refrigerators, medicine cabinets and the like. Examples of prior art work in this area include snap-on guards for children's high chair including tray portions for holding the food. The guards can be attached or detached from the tray and act as a guard to retain food, dishes, toys or the like on the tray. The guard is manufactured from a flexible transparent sheet of thin plastic material and must be of sufficient thickness to be self supporting. Snap-on fasteners are provided for securing the guard to the high chair. A device of this type is shown in U.S. Pat. No. 2,807,312 to Florian.

Other efforts have led to a proposal of a network of welded wire construction incorporating a peripheral frame and a plurality of transversely extending wire like rods. A shelf is provided with a guard assembly with upper and lower rod members having integral legs. A device of this type is shown in U.S. Pat. No. 3,137,249 to Postula.

Other work has led to the proposal of a magnetic guard rail for medicine chest cabinets to prevent accidental breakage of bottles contained on the cabinet shelves. This device includes a complex array of components, including plastic front posts, and integrally formed connecting ribs, body members, a magnetizeable shelf, cup shaped circular shelves and permanent magnets of a circular shape. The body members are held in the position on the shelf by the attraction force of the attached magnets. A device of this type is shown in U.S. Pat. No. 3,212,755 to Liss.

Hagerman in the U.S. Pat. No. 3,938,872 recognized the fact that the movement of recreational vehicles had a deleterious effect on items stored on the shelves of camper refrigerators, vans, trailers, mobile homes and various sailing or cruising boats. His solution was to provide a shelf retainer in the form of a plurality of elastic bands forming a network over the front edge of the shelves and carried from telescopical rods having their opposite ends biased longitudinally outwardly against the opposite sides of the refrigerator.

U.S. Pat. No. 3,827,574 to Craig shows a removable shelf edge and a plurality of clips extending from the lower edge of the shelf to hold a fence in place.

U.S. Pat. No. 3,752,324 to Moser shows a refrigerator shelf guard including a rigid fence-like arrangement of wires having a plurality of hooks hooked into spaces within the wire shelves of a refrigerator.

Other proposals have been made to provide laterally spaced upstanding posts on the front of shelving with hooks onto which a fence like retainer may be mounted. A device of this type is shown in U.S. Pat. No. 5,791,501 to Baldwin.

In our original application we disclosed a restraining net anchored to the side walls of a refrigerator or compartment by use of releasable anchors, each having at least one anchoring element embedded in or bonded to the wall or edge of the shelf to releasably hold a connector attached to the net. Upon using this embodiment, we noticed the items retained in the refrigerator stayed colder, indicating to us that this embodiment helps to keep items colder by restraining the loss of cold air and the ability of warmer air from the outside to enter, lending an additional purpose to the embodiment. While having utility, it was not obvious to us at the time that such restraining net could have an added benefit of retaining cold air within a refrigerator. Further, the benefit of this embodiment became more apparent upon the use of clear and solid sheet of material with thermal insulation characteristics in place of mesh material to further restrain cold air escaping from the refrigerated cabinet. Furthermore, this benefit became more enhanced if the sheet was attached and secured to the inside walls of the refrigerator using flaps to bridge the gap between sheet and the enclosure.

Upon further use of this new embodiment in refrigerators installed in both recreational vehicles and in homes, we discovered that the surface at the top of the internal compartments in these refrigerators varied greatly in uniformity and this negatively affected the ability of the device to be attached to the top of these compartments. It became apparent to us that the flaps across the top could not be attached to the compartment in many instances as we had previously designed. Furthermore, we discovered that a tension rod could be attached to or inserted through the top of the barrier sheet to hold the sheet in place securely across the inside compartment. Additionally, we realized that a second tension rod could be attached to or inserted through the sheet towards the bottom of the compartment along the bottom shelf just above the storage cabinets. This would allow for greater stabilization and security of the sheet within the compartment and would also allow us to not be required to secure the flaps along on the side of the sheet to be attached to the inside compartment of the refrigerator.

As cooling refrigerators have gained popularity in recreational vehicles, they tend to be used extensively by occupants and routinely opened and closed during use. Frequent opening to either put objects inside, take them out, or merely to view the items inside prior to taking any action causes a major loss of coldness inside the refrigerators causing food items to be exposed to higher temperatures further causing loss of freshness and a shorter duration of lifespan. This condition can also lead to increased energy requirements as the generator units of either gas-powered or electricity-driven refrigerators have to activate on a more frequent basis. This same condition of loss of cold air from frequent opening of refrigerators is also well known to be a problem facing users of household refrigerators. It is these problems which are addressed by the current invention.

It is already been recognized that there is a need for restraining cold air within all refrigerators in many different settings to prevent the loss and lifespan of perishables and the increased energy use such loss of cold air entails. Examples of known devices in this area include thermal barriers in cabinets between the refrigerator and the outside environment. Examples of such known devices are disclosed in U.S. Pat. Nos. 2,041,258 to Mitchell, 2,127,379 to Adams, 2,585,136 to Kuchler, 4,109,484 to Cunningham, 4,288,992 to Eliason, 4,296,792, 4,313,485, 4,420,027, and 4,550,760 to Gidge and Richard, 4,400,046 to Karashima, 4,429,548 to Layne, 5,431,490 to Edwards, and 6,783,199 to Parrott. Typically, these devices create thermal barriers by providing hanging vertical curtains, draped over horizontal curtains, or rigid drawers or doors. The majority of these devices are intended to isolate refrigerated chambers without storage doors.

U.S. Pat. No. 2,041,258 to Mitchell incorporated the use of a transparent curtain to provide an air-dam to be readily secured to a refrigerator in a manner to be easily detached. This curtain is made up of narrow strips hanging vertically in edge-to-edge relation allowing for a person to reach through these strips to access items on the shelves. While this does seem to provide its stated purpose of the restraint of cold air within the refrigerator, without a means of fastening these strips to any surface the hanging strips do not seem to have any ability to restrain objects.

U.S. Pat. No. 2,127,379 to Adams incorporated a transparent screen that could be unrolled from a spool at the bottom of the inside of the refrigerator and attached by means of a grappling device to one of the refrigerator shelves. While this would seem to preserve the cold air in the lower compartment, it was not a solution to keep cold air in the upper sections of the refrigerator from escaping and would not able to secure all items within the refrigerator from escaping. Furthermore, it used a celluloid material which would most likely be too flimsy to be of sufficient strength to retain objects on shelves.

U.S. Pat. No. 2,585,136 to Kuchler made use of a blind that could be raised up and down to view and retrieve items while retaining cold air inside a refrigerator. While it may have utility for that purpose, as in the case of U.S. Pat. No. 2,041,258 to Mitchell, it does not allow the user to easily see the items prior to raising the blind. It also does not provide an effective means for restraining objects on the shelves from falling out.

Further, these hanging curtain devices tend to be more suitable for open refrigerated cabinets lacking doors. Almost all RV and household commercial refrigerators have solid door units with interior storage shelves and compartments for items to be placed in and upon. According to the disclosure of U.S. Pat. No. 6,783,199 to Parrott, the previous hanging curtain devices known do not allow sufficient coldness to be distributed to the stored items held in the inside shelves and compartments of the refrigerator door. This problem was attempted to be remedied by U.S. Pat. No. 6,783,199 to Parrott by use of displacement apparatus attached to the inside of the door to contact and tilt some of the hanging curtain flaps to allow cold air to be distributed to the inside door shelves. However, the device described in U.S. Pat. No. 6,783,199 to Parrott does not provide the benefit of retaining the items upon the shelves of the cabinet or refrigerator.

It would be particularly useful to develop a device of that would be able to retain items upon the shelves of a compartment for use with refrigerators and cabinets in recreational vehicles during transit as these shelves and items are routinely exposed to instability. It would be even further useful if said device was constructed of insulating material to allow it to restrain cold air from escaping from these refrigerators in either RVs or other refrigerator applications in which the door is routinely opened. The more frequently a refrigerator door is opened, the greater the loss of cold air and this leads to higher temperatures in the internal storage area, which results in higher energy use required to maintain adequate coldness. It would also be important for this seal to be less than absolute and adjustable so as to allow cold air from the refrigerator to the inside door shelving and compartments so that items maintain proper coldness.

SUMMARY OF THE INVENTION

The restraining device of the preferred embodiment of present invention includes a sheet with sealable transparent downward opening panels to be deployed in a blocking relationship over the front edge of a horizontal shelf fixture within a compartment to be held in place by tension rods deployed across or through the top and across the bottom portion of the sheet adhered by adhesive strips of hook and loop materials applied to the tension rods and the back of the sheet, and also by means of attaching grappling devices to the front of the cabinet shelving.

Other features and advantages of the invention will become apparent from the following detailed description, taken in conjunction with the accompanying drawings which illustrate, by way of example, the features of the invention.

DETAILED DESCRIPTION OF THE PREFERRED EMBODIMENTS

Figure 1:
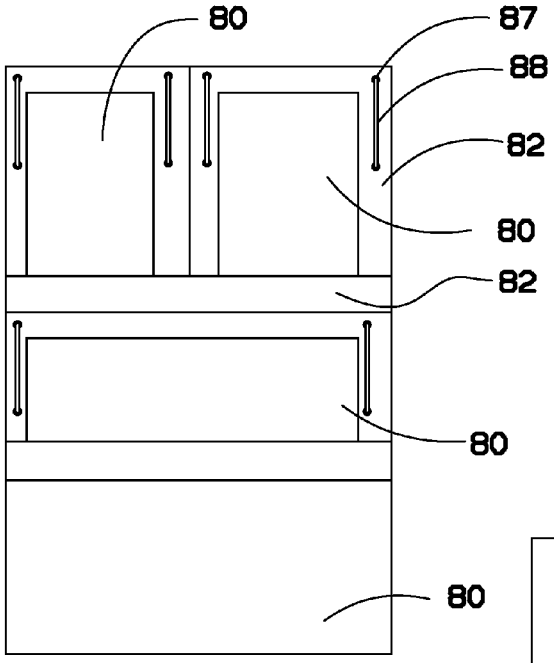
FIG. 1 is a front view of the current embodiment of a thermal barrier and constraining device depicting a sheet incorporating sealable opening panels and added drawstrings embodying the current embodiment.

This application is a continuation-in-part of our prior application Ser. No. 11/949,644, filed Dec. 3, 2007, a previous continuation-in-part Ser. No. 12/538,679, filed Aug. 10, 2009, and a further continuation-in-part Ser. No. 12/586,410 filed Sep. 22, 2009. The constraining devices shown in FIGS. 1-6 disclosed in our earlier patent application and FIGS. 7-8 of our previous continuation-in-part, while both having utility, both lack major advantages of the present invention. While not apparent to us until after some extensive testing, the suction cup anchoring devices shown at 19 incorporated in our earlier device, failed to provide sufficient long term anchoring to allow the device to perform satisfactorily, due to indeterminate irregularities in the inside wall enclosures of refrigerators. Furthermore, the anchor devices and tethers referred to in FIGS. 7 and 8, while having utility in restraining objects upon horizontal shelving, after extensive testing we determined that the previous embodiment provided a limited ability to restrain coldness within a refrigerated cabinet and could be substantially improved by further enclosing and surrounding the net material itself, while also replacing the previous net mesh material with a solid clear material which would further restrain the cold within the refrigerator while securing the net with hook and loop fasteners to further prevent items from spilling from shelves as in the previous embodiment. FIGS. 13 through 24 demonstrate the last previous embodiment of our device. The attachment to the top of the compartment shown in FIG. 13 had to be modified since we discovered there is not much uniformity among refrigerators in this regard. Along the top border of the sheet, the hook and loop material has been replaced by a tension rod spanning the distance between the sides of the compartment. The flaps depicted in FIG. 21 that run down the left and right sides of the sheet and attached to the inside walls of the compartment are no longer necessary, since the sheet is secured within the compartment by the tension rod across the top and a second tension rod along the lower part of the sheet at the lower shelf base of the compartment above the internal storage compartments. FIGS. 1 to 8 demonstrate the current embodiment of our device.

The primary improvements in this embodiment have to do with securing the device in its environment and adding to it some added adjustment mechanisms. The non-uniformity of the upper reaches of a refrigerator make securing it along the upper horizontal edges problematic. The use of tension rods with adhesive hook-and-loop material attached to them mitigates any non-uniformity and allows for an easy and secure way of fastening this device inside the compartment. By adhering the hook-and-loop material on the tension rod to correlating hook-and-loop material sewn in to the item's backside, the items can be secured much better and more completely in its environment and allow for adjustment along the horizontal and vertical axis given that these tension rods are adjustable. The adjustability of the tension rod will thereby enable this devices' use in a variety of non-standard environments. Seldom are the widths of these boxes uniform.

The second improvement is the addition of an extended piece of border material that extends past the upper horizontal border that has hook-and-loop material sewn in to it. It drapes over the tension rod and fastens to the backside vertical border material with hook-and-loop material sewn in to it. This will aid the item in staying fastened to the tension rod as the forces of opening and closing the openings can tend to pull the device away from the tension rod. These extended pieces of border material help keep the item attached to the tension rods.

The third improvement is the addition of drawstrings added to the openings on the front of the device. These drawstrings give the user a better mechanism for which to open the panels of the device. It allows for the user to peel down and away in a much easier fashion than our prior incarnations. The drawstrings replace the short tabs attached to the panels that were used to open the panels in the previous embodiment of our device.

A fourth improvement is the removal of any and all vertical edge fastening mechanisms as we found these attachment methods actually inhibited circulation of air throughout the refrigeration compartment. Most specifically was the impediment of the circulation of cool air to the shelves on the door of the refrigerator.

Lastly, two additional tethers that fasten to shelving have been added to the backside of the device to make up for loss of integrity along the vertical planes on the outer most regions of the device.

Figure 5:
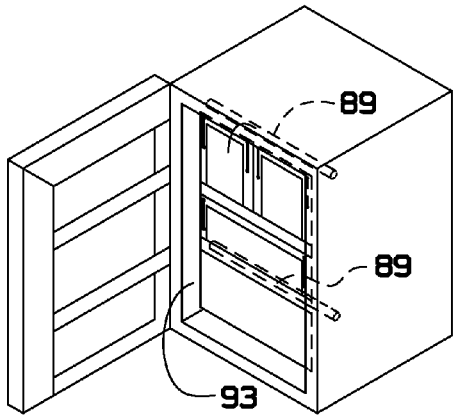
FIG. 5 depicts the device in a compartment with respective tension rods installed.

Recreational vehicle refrigerators, as depicted in FIG. 5, are in common usage in mobile homes, campers, and all different types power and sailing boats. An important aspect of enjoyment for RV users is the selection, planning, use and consumption of food stuffs and beverages during the recreational outing. Many such beverages must be chilled to enhance the flavor and food stuffs should have the heat removed for health reasons and often times to enhance flavor. Every experienced owner and operator of an RV is aware of the fact that containers of food stuffs on the shelves of the refrigerator shift under influence of acceleration forces often times slamming against the door of the refrigerator or, if open, being ejected all too often resulting in spillage or fragmentation of fragile containers. The device of the present invention is intended to constrain such containers from falling out of the refrigerator upon opening of the refrigerator door, due to the movement of the RV in transit.

FIG. 1 shows the front view of the current embodiment of the constraining device shown. The current embodiment is a sheet that has three clear sealable panels 80 which can be opened in order to access items inside. These panels are made of 20-gauge clear plastic vinyl and are enclosed by a nylon mesh fabric border 82 that is sewn together. In addition, loop material is also sewn into the backside border of each panel and along the entirety of each panel's two vertical sides and upper horizontal edge. These panels serve as entrances into the enclosure. The three panels' attachment by hook and loop system along with clear plastic vinyl is designed to maintain visibility into the contents of the enclosure as well as contain contents on the shelves and keep the enclosure cooler than otherwise without the device. Two of the panels are of identical size in the shape of square rectangles and are located at the top of the sheet and directly adjacent to the immediate side of one another. The third panel is a horizontal rectangle which encompasses the combined width of both upper panels. These panels serve as entrances into the enclosure. The three panels' attachment by hook and loop system along with clear plastic vinyl is designed to maintain visibility into the contents of the enclosure as well as contain contents on the shelves and keep the enclosure cooler than otherwise without the device. In past incarnations we used a nylon mesh fabric that has now been replaced by the clear plastic vinyl. Upon using this device, we started to notice a thermal benefit to its properties. Clear plastic vinyl was tested and it performed even better as a thermal barrier than the nylon mesh fabric. In addition, the vinyl proved to be a very good material to sew into the borders and hook-and-loop material. By having a three-panel system, one only needs to access one panel to remove an item, thereby keeping the other panels closed, and aiding in keeping the refrigerator opening sealed best as possible.

The two panels are separated from the third panel by a border 82 located between them. A second border 82 below the third panel separates the third panel from a flap or apron 80, which constitutes another panel 80 which does not have a sealable opening, and has no border.

FIG. 1 depicts the device with added drawstrings (88). These drawstrings are attached to the device by passing through holes (87) and knotted on the backside of the border of the panel. These drawstrings allow a user to grab them and pull down and away, making opening much easier than our last previous version, which used shorter pull tabs.

Figure 2:
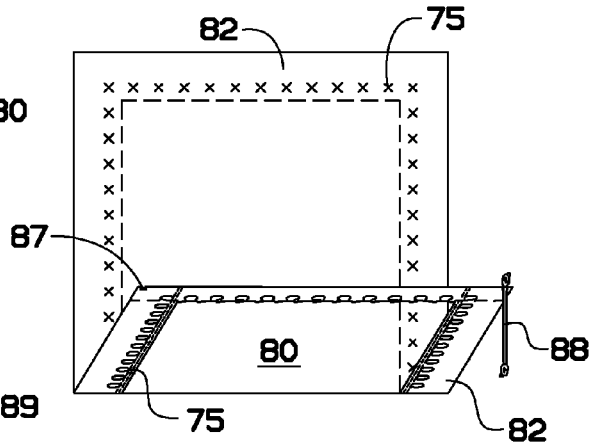
FIG. 2 is a cutaway front view of an individual panel depicting the method of how the panel might pull down and away from the device with the aforementioned drawstrings.

FIG. 2 shows a cutaway view of one panel being opened and pulled away from the device with drawstring (88) and corresponding holes (87) and the knot on the backside of the border material of the panel. Hook and loop material (75) sewn into the back side of panel (80) depicted in "O's" marries to hook-and-loop material (75) sewn into border material (82). These panels are downward opening so as to aid in loading and unloading food items allowing the panels to remain open with the use of gravity, if so desired.

Figure 3:
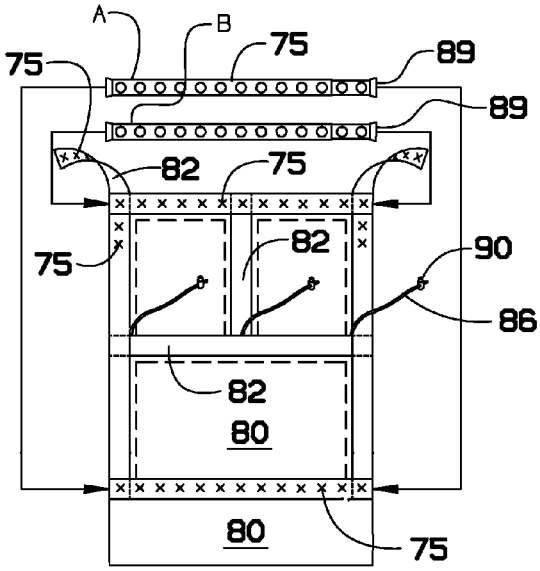
FIG. 3 is a rear view that depicts the tension rods with hook-and-loop material marked "O" and the backside of the device with corresponding attaching hook-and-loop material marked as "X" that attaches to tension rods.

FIG. 3 shows tension rod (89), two of them, and the adhered hook-and-loop material (75), marked with "O", and the backside of the device with the opposing hook-and-loop material (75) sewn in to the rear border material marked with "X". The "O's" and "X's" correlate to the hook-and-loop material that marries together for securing the device in the box. The lines and arrows show the "marrying" of the two rods with their spots on the backside of the device.

The tension rods have an oval shape with a slight flatness on the face of them. The flatness gives more surface area for the adhered hook-and-loop material which allows for more contact area with the flat aspect of the backside of the device's sewn in horizontal hook-and-loop material (75).

The backside horizontal hook-and-loop strips (75) that have been sewn in are slightly oversized in respect to the surface area of the tension rod's hook-and-loop. This will allow a user to adjust the device in the vertical plane.

FIG. 3 also shows the added tethers (86) on the edges of the device around midline with corresponding cord locks (90) which fasten to the shelving of the compartment. This will allow a user to secure the device against the shelving along the entire horizontal distance, about midline, and especially securing the edges at midline. This will give the entire device added strength and aid in keeping items secure on the shelving.

Figure 4:
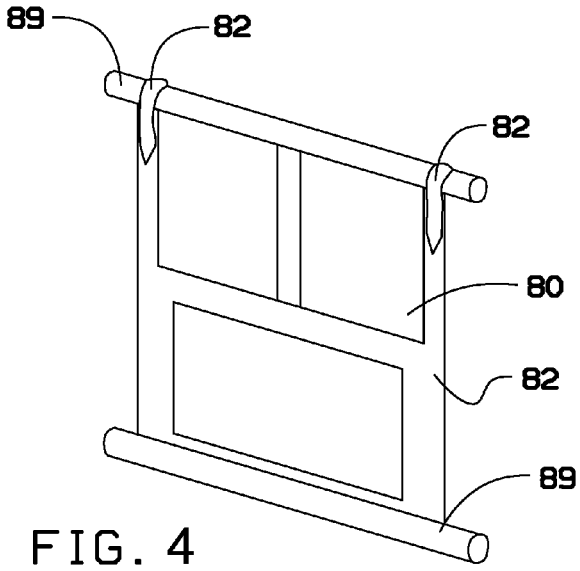
FIG. 4 is a rear-view showing the extended portions of the border material draped over the top of tension rod and attached to the backside.

FIG. 3 also depicts the extended portions of the border material (82) along the vertical edges that extend past the horizontal edge. They are affixed with hook-and-loop material (75) and loop over the tension rods as shown in FIG. 4. This will help keep the device married to the horizontal tension rods.

FIG. 4 shows how the extended border material (82) fastens over the tension rod (89) which allows for further securing of the device on the tension rod.

FIG. 5 shows the approximate locations of the tension rods (89) in a compartment-like environment and the device's orientation to the tension rods (89).

Figure 6:
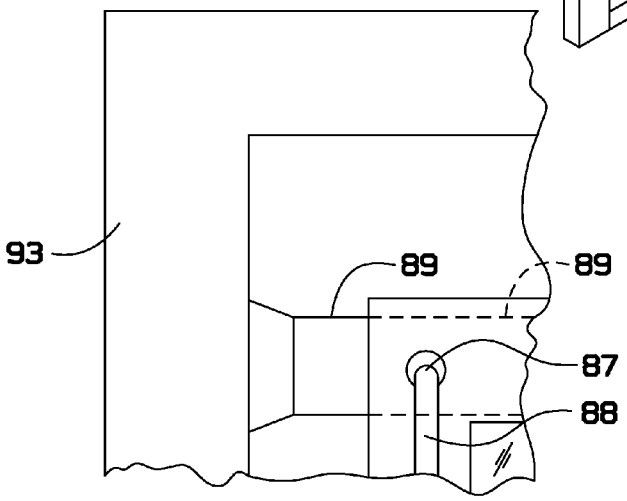
FIG. 6 shows the tension rod and its union to the side of the inside wall.

FIG. 6 shows the tension rod (89) and its contact with the wall of the compartment along with the device attached to it with drawstring (88) and corresponding hole (87).

Figure 7:
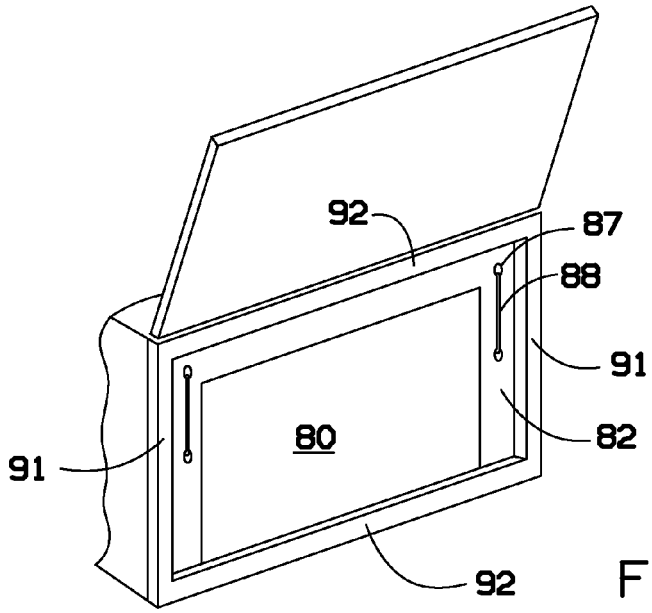
FIG. 7 shows a scaled down version of the item in a cabinet.

FIG. 7 shows an alternative location for a scaled down version of the item, in cabinetry.

Figure 8:
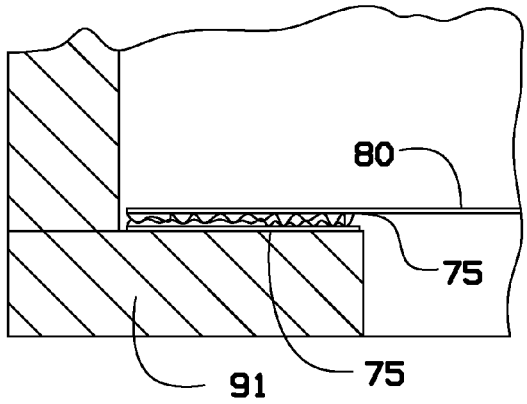
FIG. 8 shows how this scaled down version attaches to the inside walls of cabinetry.

FIG. 8 shows how this scaled down version would attach to the inside walls of cabinetry where hook-and-loop material (75) would adhere to clear plastic vinyl (80) and attach to hook-and-loop material (75) that has been adhered to the walls of the cabinet (91). The hook-and-loop material (75) would adhere to the entire border of the clear plastic vinyl (80) and would fasten via hook-and-loop material (75) along all inside four (4) borders of cabinet walls (91).

Referring back to FIG. 7, after adhering to all four cabinet walls, the device would then be secured in place and one would only need pull on a drawstring (88) to gain access to the compartment.

It would be obvious to anyone skilled in the art to use any material that might restrict air flow and allow for viewing items inside the enclosure such as windscreen material or fine plastic mesh, plexiglass panels, plexiglass doors with hinges, even heavier gauge vinyl. One might even choose to use a more thermally insulated vinyl. Limitations of such a choice would include lack of cold air reaching foodstuffs usually found in the door on the same refrigerator.

Furthermore, it would be obvious to anyone skilled in the art to use different forms of access such as zippers and hooks attached to the panels. One might even chose to forgo a panel system completely and use a vertical access slit accompanied with a zipper or hook-and-loop material or a combination of both items. If the device were solely built for the residential household community, the need to contain items on a shelf would be diminished and one might find the use of magnets securing the panels in place versus a hook-and-loop system advantageous.

One skilled in the art might find a way to gain access through the portals without unlatching them by creating a hole through the panels but maintaining air integrity and blocking.

It would be obvious to anyone skilled in the art to find different means of securing tension rods into or onto the device which could mean sewing them directly into the device to create a more permanent attachment. Or, they may find the use of more than two straps that wrap over the upper tension rod useful.

One might find a way to bridge the gaps that exist along the borders that would still enable air flow to the refrigerator doors such as we did in our prior filings: Flaps with holes in them, brushes that attach to the device, etc.

As our rear tethers that attach to shelving are fixed, one skilled in the art might find ways to make them moveable which would allow for greater alignment with shelving since shelving might be fixed in place.

In respect to the current embodiment, we have chosen to show a design most aptly fitted to a common refrigerator one might find in the larger Class A RV market. The three panels allow for ample access into the compartment as well as viewing. In a smaller version, one that could be used for cabinetry, a single panel would most likely be used in substitution of the three-panel system, without negating any utility whatsoever.

We have chosen to use loop material for the back of the border material 82 of the device and adhesive back hook material to attach to the panel's borders 75 and its respective strips of hook-and-loop material. One side would be the loop material and the other would be the hook material as show in FIG. 3. This could easily be changed to the same hook or loop material on both sides, with one on the front and one on the back, interchangeable in any combination.

FIG. 3, which is a backside view of the device, shows item 86 which is a nylon cord. There are three nylon cords 86 sewn into the midpoint of the device in the border 82 seam and these cords serve to offer further securing of the device to edges and ledges of targeted enclosures. The cords are attached to keep the middle section of the device from separating from the shelving and ledges. As we were developing larger barrier devices, it became apparent that the size of the device necessitated the securing of the mid-section of the sheet for they are quite wider and longer.

The nylon cords 86 can be fastened to the shelving in many fashions. It can be tied directly to wire shelving found in most refrigerators, can have a hook on it, even cord locks. It is the function of the cord and how it aids in securing the middle line of the barrier to the shelves that has us abandoning the zipper. After using this device with the zipper plus the cord, we found that gaining access to items in the refrigerator became quite prohibitive in the extreme reaches so we developed the paneling system. With the panel's ease of access to any one of the enclosure's three quadrants, we eliminated the zipper completely.

The entire fastening system including the tension rods and the loop backside border and the nylon cord incorporated into this device could easily be altered by anyone skilled in the art. These alterations may take the form of loops attached to device, cords, snaps, zippers, magnets or various devices that have made their way into the market in recent times including Mini Hooks with Command™, plastic adhesive-backed hooks, manufactured by the 3M Corporation of St. Paul, Minn.

As shown in FIG. 1, in this particular embodiment apron flap 80 would extend downwards past border 82 and would serve to cover the drawers that are typically found at the bottom interiors of most refrigerators that occupy homes, RV's, and yachts. It is included to serve as a continuation of the device's surface area that serves to seal up the refrigerator opening. Smaller refrigerators are usually void of any drawers in their enclosures, in which case an apron would be unnecessary. Therefore, a device without any apron would be needed for these types of enclosures as well as any enclosure that is not a refrigerator such as a cabinet or medicine/vanity cabinet on RV's or yachts. Anyone skilled in the art might find it advantageous to anchor the flap down with snaps, hook-and-loop material, loops, hoops, weights or by other means.

It will be appreciated that the vinyl sheet and strips of adhesive loop material of the present invention may be manufactured and packaged together for distribution in, for instance, recreational vehicle cabinets and refrigerators and ship supply houses. The barrier and constraining device will typically be provided in, for instance, three main sizes, large, medium and small to fit in captive relationship over the opening at the edge of a refrigerator or of a shelf fixture within a compartment.

A user may then purchase the package which may also include an adhesive or bond, or in some instance, may include the strip of adhesive-backed loop material 75 fabricated with an adhesive back side thereof and covered by a peel off cover strip.

The user will purchase the restraining device of a size which may complementally fit the access opening or openings of his or her shelving or refrigerator and can readily install the device by peeling the cover strip off the backing off the strip 75 of adhesive-backed loop material and adhering the respective strips to the wall of the refrigerator or shelving in spaced relationship around the opening to be covered.

It will be appreciated that the user has the option of, prior to installation, sizing up the arrangement by placing the sheet temporarily over the opening to determine where the tension rods will need to be mounted in the compartment to secure the sheet to close the gap between the sheet and the top of the compartment.

The manner of installing the current embodiment for use is for the user to first clean the interior of the cabinet or refrigerator in which the user desires to install the unit. The user would then attach the tension rods to the sheet at the top and about two-thirds down by pressing together tension to the device. The tension rod on top would be mounted near the very top of the cabinet and once in place the user would repeat the process and install the second tension rod at the bottom of the lower shelf and just above the storage drawers. Once the tension rods are secured, the user could then attach the nylon cords 90 to the interior shelving to help keep the center of the barrier close to the edge of the shelving.

Once installed, the user would then need to grab one of the drawstrings 88 attached in the corner of each panel and pull down in order to open each panel 80 in order to either remove or place objects on the shelving inside of the cabinets. Once the user is finished, the user would then close the panel pushing it up and reattaching the hook material on the backside of the panel 80 to the loop material on the border 82 of the sheet.

ADVANTAGES

From the foregoing it will be appreciated that the constraining barrier of the present invention provides for convenient and inexpensive installation presenting the utility that the barrier sheet is positively secured in place by tension rods secured to the wall of the refrigerator or cabinetry to positively anchor the net in place against dislodgement under application of relatively high acceleration and deceleration forces and against dislodgement on being vibrated under normal condition of a typical recreational vehicle. Three nylon cords serve to further anchor the midsection. Further, the use of the nylon mesh fabric border, and hook-and-loop fastening elements when used in combination with the sheet holds items within the horizontal shelving of the cabinet so that they do not spill out upon opening of the door. The use of clear vinyl panels in the sheet allows the user to be able to see the contents of the cabinet or refrigerator when installed and employed. The use of the individual sealable downward opening panels allows the user to easily access the items within the refrigerator or cabinet to retrieve or place items while leaving most of the barrier in place.

Furthermore, it will be appreciated that the constraining barrier of the present invention provides for the utility of retaining cold air within a refrigerator upon frequent opening and closing of the door, which is a normal condition when using a refrigerator with a solid door device. This benefit is further enhanced due to the nature of recreational vehicles, which are routinely operated in warm climates and are often without the convenience of air conditioning to cool the interior environment housing the refrigerator units. The use of the clear vinyl material having thermal insulation characteristics composing the sheet panels further enhances its ability to restrain cold air within a refrigerator. The use of the clear panels in the sheet within a refrigerator provides visibility and allows the user to search for items while the cold air is restrained within to minimize the loss of cold air from the refrigerator. The use of the panel flaps allows for restricted opening of the barrier sheet to just the area where the item is desired to be retrieved or placed, minimizing the loss of cold air from the refrigerator.

This device could serve the household refrigerator market as well. Its constructed thinness is ideally suited for the space between the closed door and the refrigerator's edges. It provides the same thermal benefit. People who have children prone to leaving the door open, have a high frequency of placing and retrieving items from their refrigerator shelves, live in hot or very warm climates, or even have problems with items falling off their shelves due to crowding of items or even shifting from seismic activity might enjoy the benefit the barrier provides.

Anyone skilled in the art might also find this device useful for child-proofing cabinets and refrigerators as well as earthquake-proofing the same type of enclosures. It would also work well to attach to a refrigerator door, or any other door that might need to have its items secured from falling out.

CONCLUSION, RAMIFICATIONS, AND SCOPE

Thus the reader will see that at least one embodiment of the device provides an easy-to-use yet effective means of retaining items upon shelving within refrigerators and cabinets and for retaining cold air within refrigerators that can be used by many users in many different settings. While our above description contains many specifics, these should not be construed as limitations on the scope, but rather as an exemplification of one preferred embodiment thereof. Many other variations are possible. For example, the sheet panels could be constructed of other materials, such as plastic, nylon, mesh netting, etc. each having various abilities to act as a thermal barrier.

the panel flap fasteners of hook-and-loop material could be replaced with other fastening devices, such as zippers, magnets, buttons, latches, hooks, etc. for means of forming opening in the sheet to place and retrieve objects.

the sheet border could be constructed of other materials, such as plastic, plexiglass, rayon, or rope material sufficiently strong enough to secure the panels and the attachments to the enclosure.

the tension rods and means of securing the device within the cabinet could be made of plastic or nylon pieces and secured by means of adhesives, adhesive hooks, or suction cup devices.

Thus the scope of the embodiment should be determined by the appended claims and their legal equivalents, rather than by the examples given.

We claim:

1. A thermal barrier and item retaining apparatus for preventing ejection or items from a horizontal shelf within a compartment, the compartment having spaced apart walls and comprising:

(a) mounting devices for mounting to the inside of the compartment in a spaced apart relationship and including respective fastener devices to fasten the mounting devices to a sheet configured to be deployed;

(b) a sheet configured to be deployed and attached to the mounting devices by use of the corresponding respective fastener devices; the sheet configured to form a blocking structure in front of the front edge of the shelf; the sheet including sealable, downward opening, transparent panels for access to the items and including a parametrical border around the panels;

(c) additional fasteners attached to the back side of the sheet at two or more sheet locations not on openeable panel; the additional fasteners comprising tethers configured to be attachable to a horizontal shelf to retain the sheet securingly in position against the front edge of the shelf;

(d) a strings attached at a top corner of at least one panel opening to allow the easy separation of the top of a panel from the surrounding sheet portion by gripping said strings and applying a downward pulling action to cause an opening in the sheet to be formed.

2. The thermal barrier and retaining apparatus of claim 1 where the parametrical border is constructed of reinforcing material.

3. The thermal barrier and retaining apparatus of claim 1 where the sheet is constructed of clear vinyl material.

4. The thermal barrier and retaining apparatus of claim 1 where the parametrical border is constructed of a nylon belt.

5. The thermal barrier and retaining apparatus of claim 1 where the sheet in is constructed of nylon mesh.

6. The thermal barrier and retaining apparatus of claim 1 where the sheet is constructed of plastic mesh.

7. The thermal barrier and retaining apparatus of claim 1 further comprising nylon cords attached to the backside of the sheet with grappling-type devices attached to said nylon cords hook on to wire shelving.

8. The grappling type devices of claim 7 allow for adjustment at the adjustment of length of said nylon cord as to make up for variability of shelving spacing in respect to said nylon cords enabling the snug fit of blocking aspect of thermal barrier and retaining apparatus to said shelving for blocking purposes.

9. A thermal barrier and item retaining apparatus for preventing ejection or items from a horizontal shelf within a compartment, the compartment having spaced apart walls and comprising:

(a) mounting devices for mounting to the inside of the compartment in a spaced apart relationship and including respective fastener devices to fasten the mounting devices to a sheet configured to be deployed;

(b) a sheet configured to be deployed and attached to the mounting devices by use of the corresponding respective fastener devices; the sheet configured to form a blocking structure in front of the front edge of the shelf; the sheet including sealable, downward opening, transparent panels for access to the items and including a parametrical border around the panels;

(c) a string attached at a top corner of at least one panel opening to allow the easy separation of the top of a panel from the surrounding sheet portion by gripping said string and applying a downward pulling action to cause an opening in the sheet to be formed, further the mounting devices are adjustable tension rods.

10. The thermal barrier and retaining apparatus of claim 9 further comprising tethers comprised of nylon cords attached to the back side of the sheet with spring-loaded plastic cord locks attached to said nylon cords wrap around wire shelving.

11. The plastic cord locks of claim 10 allow for adjustment of length of said nylon cord as to make up for variability of shelving spacing.

* * * * *